US006662620B1

(12) United States Patent
Baron et al.

(10) Patent No.: US 6,662,620 B1
(45) Date of Patent: Dec. 16, 2003

(54) STEEL STUD CRIMPER

(75) Inventors: Michael P. Baron, Phoenix, MD (US); Michael O'Banion, Westminister, MD (US)

(73) Assignee: Black & Decker Inc., Newark, DE (US)

( * ) Notice: Subject to any disclaimer, the term of this patent is extended or adjusted under 35 U.S.C. 154(b) by 407 days.

(21) Appl. No.: 09/660,452

(22) Filed: Sep. 12, 2000

(51) Int. Cl.[7] ..... B25B 28/00; B25D 11/10

(52) U.S. Cl. ..... 72/452.4; 72/452.7; 72/409.01

(58) Field of Search ..... 72/452.4, 452.7, 72/409.1, 409.09

(56) References Cited

U.S. PATENT DOCUMENTS

| | | | | |
|---|---|---|---|---|
| 2,208,058 A | | 7/1940 | Smith | |
| 2,224,708 A | * | 12/1940 | Van Sittert | 72/452.7 |
| 2,846,633 A | | 8/1958 | Gingrich | |
| 3,397,567 A | | 8/1968 | Klingler | |
| 3,520,391 A | | 7/1970 | Graham et al. | |
| 3,617,837 A | | 11/1971 | Beck | |
| 3,877,280 A | | 4/1975 | Cornell | |
| 3,878,521 A | | 4/1975 | Licitis et al. | |
| 3,925,875 A | | 12/1975 | Doke | |
| 4,109,504 A | | 8/1978 | Rommel | |
| 4,173,069 A | | 11/1979 | Sidenstick et al. | |
| 4,199,973 A | * | 4/1980 | Laux | 72/409.01 |
| 4,418,562 A | | 12/1983 | Sakai et al. | |
| 4,433,569 A | * | 2/1984 | Santinelli | 72/409.01 |
| 4,893,493 A | | 1/1990 | Jacques et al. | |
| 4,914,941 A | | 4/1990 | Ijiri et al. | |
| 4,932,237 A | | 6/1990 | Hatfield | |
| 4,989,438 A | | 2/1991 | Simon | |
| 5,040,400 A | | 8/1991 | Nastasi | |
| 5,111,681 A | | 5/1992 | Yasui et al. | |
| 5,195,354 A | | 3/1993 | Yasui et al. | |
| 5,272,811 A | | 12/1993 | Armand | |
| 5,299,848 A | | 4/1994 | Boyer | |
| 5,553,478 A | | 9/1996 | Di Troia | |
| 5,657,417 A | | 8/1997 | Di Troia | |
| 5,697,146 A | | 12/1997 | Inoue et al. | |
| 5,718,142 A | | 2/1998 | Ferraro | |
| 5,720,199 A | * | 2/1998 | Dischler | 72/452.4 |
| 5,727,417 A | | 3/1998 | Moffatt et al. | |
| 5,819,570 A | | 10/1998 | Mori et al. | |
| 5,839,316 A | | 11/1998 | Kolivoski et al. | |
| 5,884,405 A | | 3/1999 | Breeden | |

FOREIGN PATENT DOCUMENTS

| | | |
|---|---|---|
| DE | 1503141 | 12/1969 |
| DE | 2316 769 C3 | 10/1974 |
| DE | 3719 442 C2 | 12/1988 |
| DE | 3207 063 C2 | 6/1992 |
| DE | 4321 249 C2 | 1/1995 |
| DE | 295 02 032.6 | 5/1995 |
| DE | 4402 440 C2 | 8/1995 |
| DE | 197 09 017 A1 | 6/1998 |
| EP | 424 190 B1 | 3/1994 |
| EP | 389 716 B1 | 5/1994 |
| EP | 631 850 B1 | 4/2000 |
| WO | WO 96/31319 | 10/1996 |

* cited by examiner

*Primary Examiner*—David Jones
(74) *Attorney, Agent, or Firm*—Harness, Dickey & Pierce, P.L.C.

(57) ABSTRACT

A crimping tool is provided including a rotary drive unit and removable extension arm with pivotal jaw arms. The removable extension arm is rotatable about its axis. A locking device is included in the jaw arm assembly such that the jaw arms may be securely positioned in a number of locations to accommodate various working angles. A logic circuit limits the movement of the jaw arms to one complete cycle for each trigger event.

28 Claims, 7 Drawing Sheets

STEEL STUD CRIMPER

FIELD OF THE INVENTION

The present invention relates generally to hand tools, and more particularly to a power tool for crimping steel studs and tracks during construction framing.

BACKGROUND

Steel framing has become increasingly popular for residential and commercial buildings due to the increased strength and termite resistance of steel relative to wood. However, the process of assembling steel framing is time consuming and expensive relative to the material costs. As a result of these increased labor costs, steel framing has been slow to achieve wide-spread acceptance.

Presently steel studs and tracks are assembled either vertically or horizontally with each of the studs screwed to the track. In horizontally constructed walls, the studs and tracks are positioned on the floor relative to one another and screws are placed in one side of each track to secure each stud to the track. The wall is then flipped over and screws are inserted into the other side of each track. In vertically constructed walls, the laborer must work on each side of the wall to screw the studs into the tracks on the top and bottom of the wall. The top is difficult to reach and the bottom requires that the operator bend or kneel on the floor.

Crimping tools have also been utilized to connect the studs to the tracks. However, manual crimping tools require a lot of strength and endurance to operate on large jobs and power crimping tools have proven to be heavy and cumbersome. The inefficiency of prior methods for assembling steel studs to the tracks has contributed greatly to the labor costs for steel frame construction.

Given the aforementioned drawbacks, it is desirable to provide a power crimping tool that alleviates much of the labor costs associated with steel framing

SUMMARY OF THE INVENTION

It is an object of the present invention to provide a hand-held crimping tool that can be properly aligned while providing the user with a broad range of workable engagement angles.

It is another object of the present invention to provide a rotary drive tool with a releasably attached extension arm that is rotatable about its axis.

It is still another object of the present invention to provide a jaw arm assembly that is pivotally attached to the extension arm.

It is a further object of the present invention to provide a crimping tool that achieves one complete crimp cycle for every trigger activation.

It is yet another object of the present invention to provide a hand-held crimping tool that has a self-contained power source.

In order to obtain these and other objects, the present invention provides a crimping tool including a rotary drive unit and an extension arm. The extension arm includes a pivotally attached jaw assembly attached thereto. Upon activation of the rotary drive tool, the gear configuration in the extension arm translates a rotary input into actuation of the jaw assembly. The jaw assembly includes a first piercing jaw arm and a second receiving jaw arm for cyclical engagement therewith. A logic circuit limits an activation to one complete crimping cycle of the jaw assembly.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
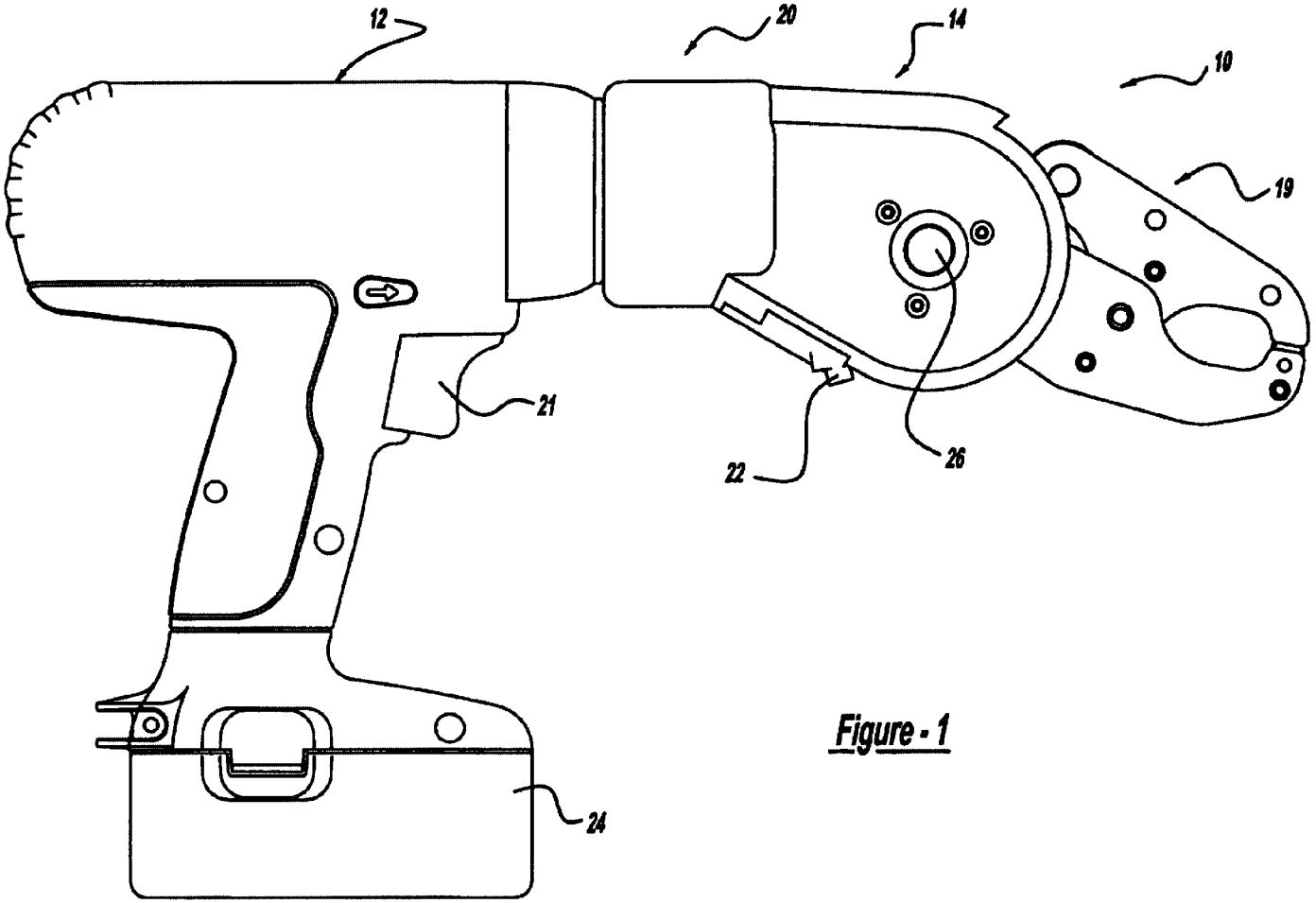
FIG. 1 is a side view of the crimping apparatus constructed in accordance with the teachings of the preferred embodiment of the present invention shown with the extension arm located in the center position.

As is most clearly illustrated in FIG. 1, the crimp tool 10 of the present invention generally includes a rotary drive tool 12 and a crimp attachment 14. The rotary drive tool 12 includes an output shaft (not specifically shown) that is coupled to a rotary shaft 16 (FIG. 9) with a connecting device carried in an extension barrel 20 which also houses a transmission 18 (best shown in FIG. 4). Power source 24 interconnects to drive tool 12. The barrel 20 is rotatable about its longitudinal axis and a jaw assembly 19 is coupled to the barrel 20 for pivotal movement relative thereto. The transmission 18 transfers the rotary motion of the rotary shaft 16 to articulate the jaws as hereinafter described.

Figure 2:
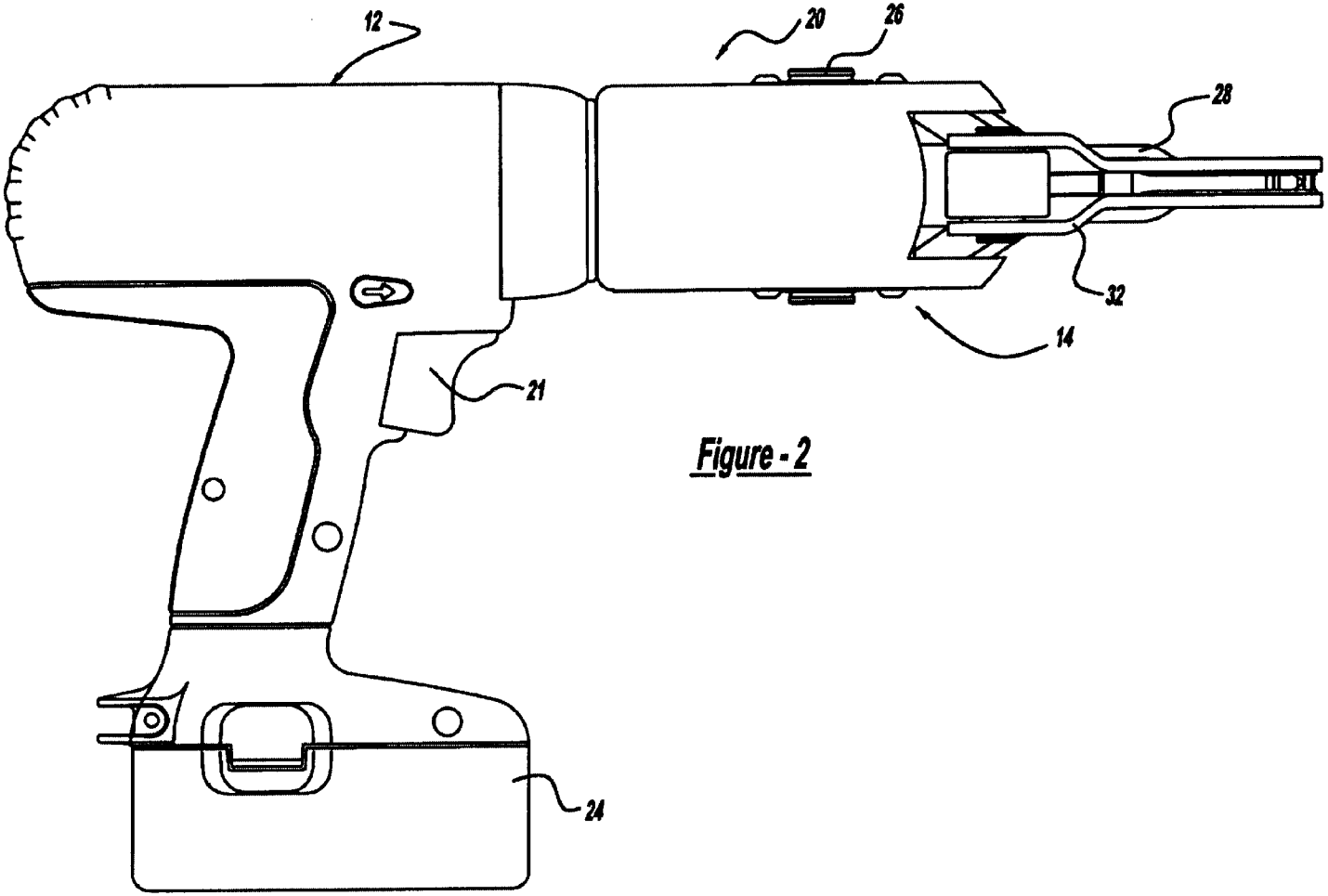
FIG. 2 is a side view of the extension arm and jaw assembly shown with the barrel rotated 90 degrees from the rotary drive tool.
Figure 3:
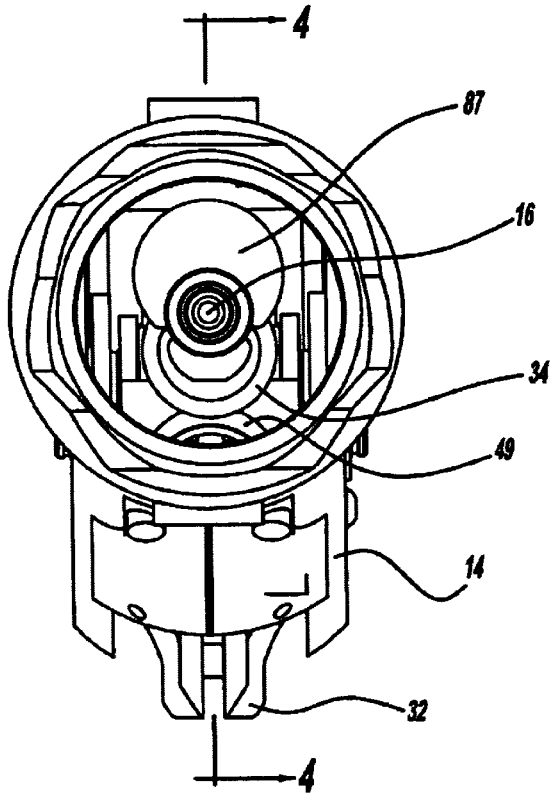
FIG. 3 is a rear view of the extension arm removed from the tool for purposes of illustrating the conical cam configuration.

As is most clearly illustrated in FIGS. 1 and 2, the jaw assembly 19 is coupled to pivot relative to the barrel 20 by a pivot shaft 26 to allow the laborer to move the jaw assembly 19 to a proper position prior to crimping. By allowing the barrel 20 to rotate about its longitudinal axis and the jaw assembly 19 to pivot about shaft 26, the crimp tool 10 permits the laborer to position the jaw assembly 19 to crimp both sides of the stud/track from the same side of the wall.

With reference to FIGS. 4–10, the transmission 18 operatively couples the jaw assembly 19 to the rotary shaft 16 such that rotation of the shaft 16 causes pivotable movement of an upper jaw 28 about a pivot pin 30 fixed to a lower jaw 32. Rivet 81 holds the members that comprise the upper jaw arm 28 together and rivet 82 holds the members of the lower jaw arm 32 together. Accordingly, movement of the upper jaw 28 from its open position to its closed position causes a piercing bit 33 to deform the stud and frame thereby crimping the two members together. The surface of the lower jaw 32 that accommodates the piercing bit 33 may be configured to fold over the resulting burr thereby limiting the distance that the burr protrudes from the stud or track.

Figure 4:
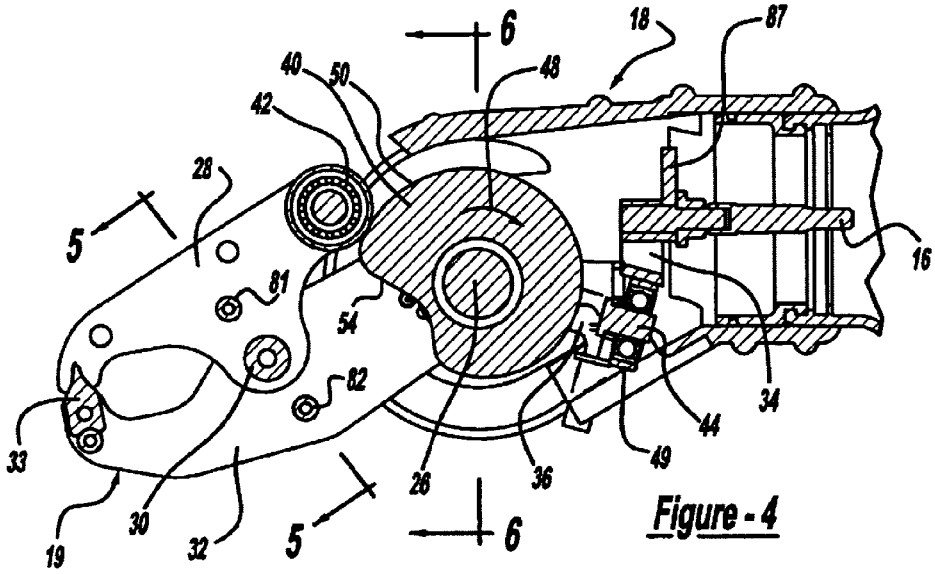
FIG. 4 is a cross-sectional view of the jaw assembly taken along line 4—4 of FIG. 3.
Figure 5:
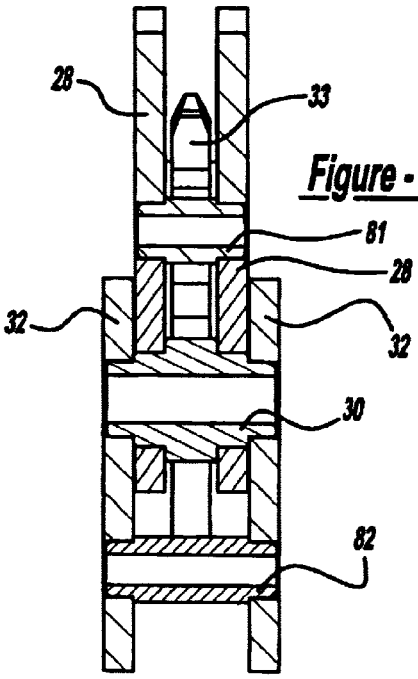
FIG. 5 is cross-sectional view of the jaw assembly taken along line 5—5 of FIG. 4.
Figure 6:
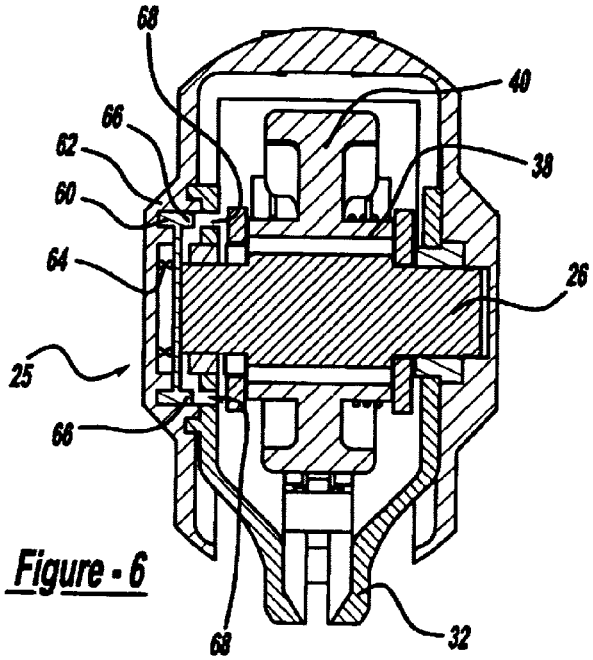
FIG. 6 is a cross sectional view of the jaw assembly taken along line 6—6 of FIG. 4.
Figure 7:
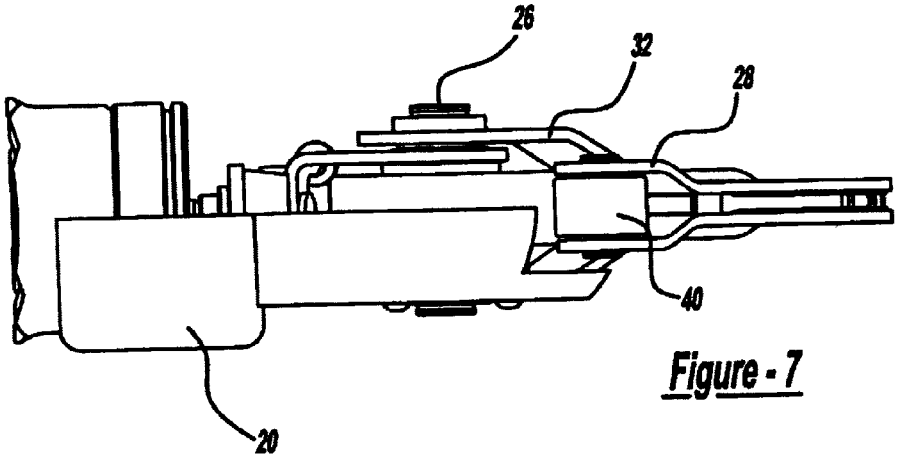
FIG. 7 is a cutaway view of the jaw assembly with half of the housing cutaway for illustrative purposes.
Figure 8:
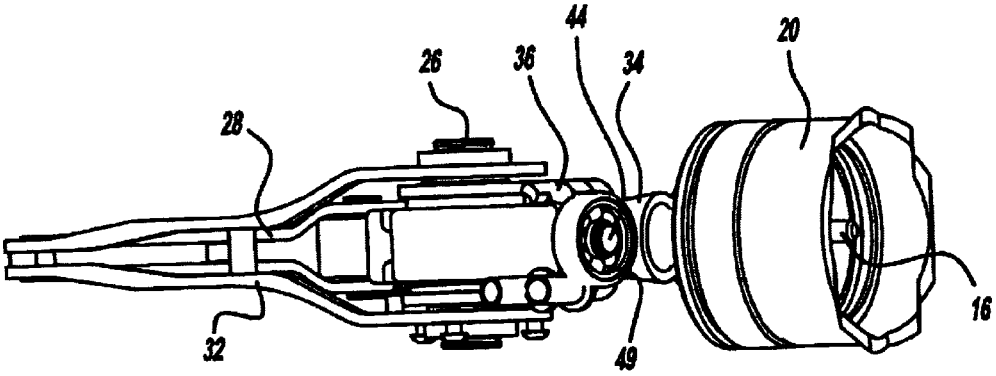
FIG. 8 is a bottom view of the jaw assembly with the housing removed.

Referring now to FIGS. 4–6, transmission 18 includes a cam 34 fixed for rotation with rotary shaft 16, a rocker arm 36 having a first end 44 engaged with cam 34 and a second end 45 fixed to rotate with shaft 26. A counterweight 87 extends from shaft 16 to encourage smooth operation. The first end 44 includes a bearing 49 which acts as a cam follower to cam 34. Cam 34 is configured to have an eccentric surface 35 to engage bearing 49 in a common plane while rocker arm 36 rotates. A drive cam 40 is coupled to the shaft 26 by a roller clutch 38 (FIG. 6). The upper jaw 28 includes a cam follower 42 that engages drive cam 40 to displace the upper jaw 28 between its open and closed positions in response to rotation of the drive cam 40. As rotary shaft 16 rotates cam 34, the eccentric surface 35 of the cam 34 oscillates the first end 44 of the rocker arm 36 in pivoting motion about the axis 46 of shaft 26. More particularly, the riding engagement between the first end 44 of the rocker arm 36 and the rotating cam 34 causes cyclical displacement of the rocker arm 36 at a magnitude of 15 degrees for each full rotation of the cam. The rocker arm 36 is biased toward cam 34 by a spring 58 (FIG. 9) to influence contact thereto. Spring 58 is supported on one end by finger 56 extending from rocker arm 36 and on the other end by protruded housing portion 22 (FIG. 1) of crimp attachment 14. The shaft 26 is fixed to, and cycles with, the rocker arm 36. This incremental rotation is transferred to the drive cam 40 by the one-way roller clutch 38 so as to index the drive cam 40 to rotate in the direction of arrow 48 (clockwise). Specifically, the one way roller clutch 38 couples the drive cam 40 to the shaft 26 such that the drive cam 40 rotates clockwise with the shaft 26 while allowing the shaft 26 to rotate relative to the drive cam 40 when the shaft 26 rotates in the counterclockwise direction.

The drive cam 40 includes an outer cam surface 50 upon which the cam follower 42 rides. The outer cam surface 50 defines a lift angle that radially diverges from axis 46 in the direction of arrow 48. Thus, rotation of the drive cam 40 radially displaces the cam follower 42 thereby causing the upper jaw 28 to pivot about pin 30 from its open position toward its closed position. The drive cam 40 includes a recess 54 within which the cam follower 42 falls to return the upper jaw 28 to its open position.

In addition to the piercing movement of the upper jaw 28, the present invention allows for the position of the jaws to be adjustable through rotation of the barrel 20 or articulation of the jaw assembly 19 about shaft 26.

The crimp tool can optionally include a lock assembly 25 for fixing the position of the jaws prior to the crimping operation. As is best illustrated in FIG. 6, the lock assembly 25 includes a locking plate 60 that is movable within the barrel housing 62 from an engaged position to a disengaged position against the bias of a spring 64. The plate 60 includes locking tabs 66 configured to engage cooperatively configured locking apertures 68 formed in the lower jaw 32 to fix the lower jaw 32 to the barrel housing 62. To change the angular orientation of the jaw assembly 19 relative to the barrel housing 62, the laborer can place the locking plate 60 in its disengaged position by axially displacing the shaft 26 toward locking plate 60 thereby moving the tabs 66 from engagement with the lower jaw 32. The locking plate 60 can include a plurality of peripherally spaced locking apertures 68 to permit the user to fix the lower jaw 32 in a variety of positions relative to the barrel housing 62.

Figure 9:
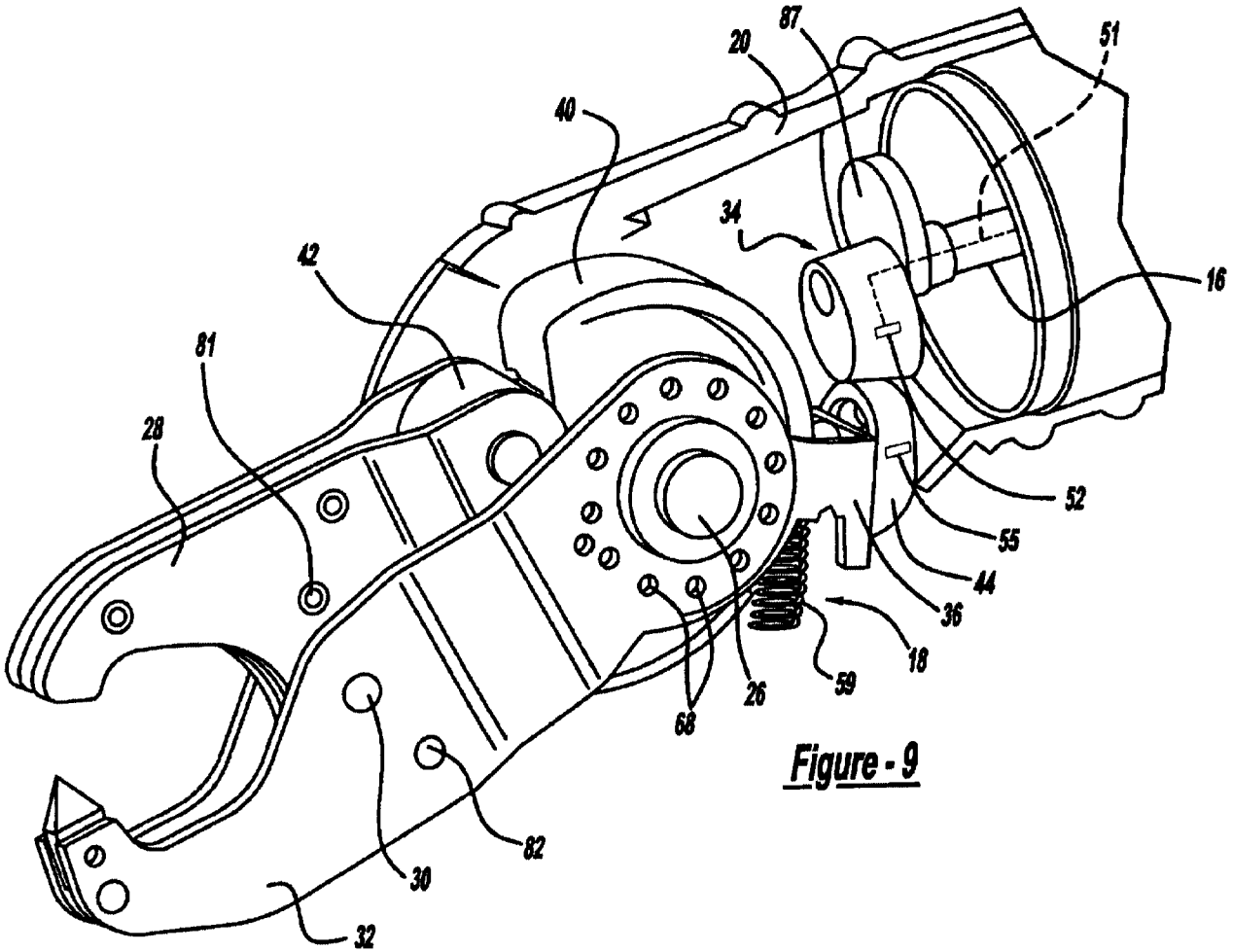
FIG. 9 is a cutaway perspective view of the jaw assembly with part of the housing cutaway to illustrate the transmission.
Figure 10:
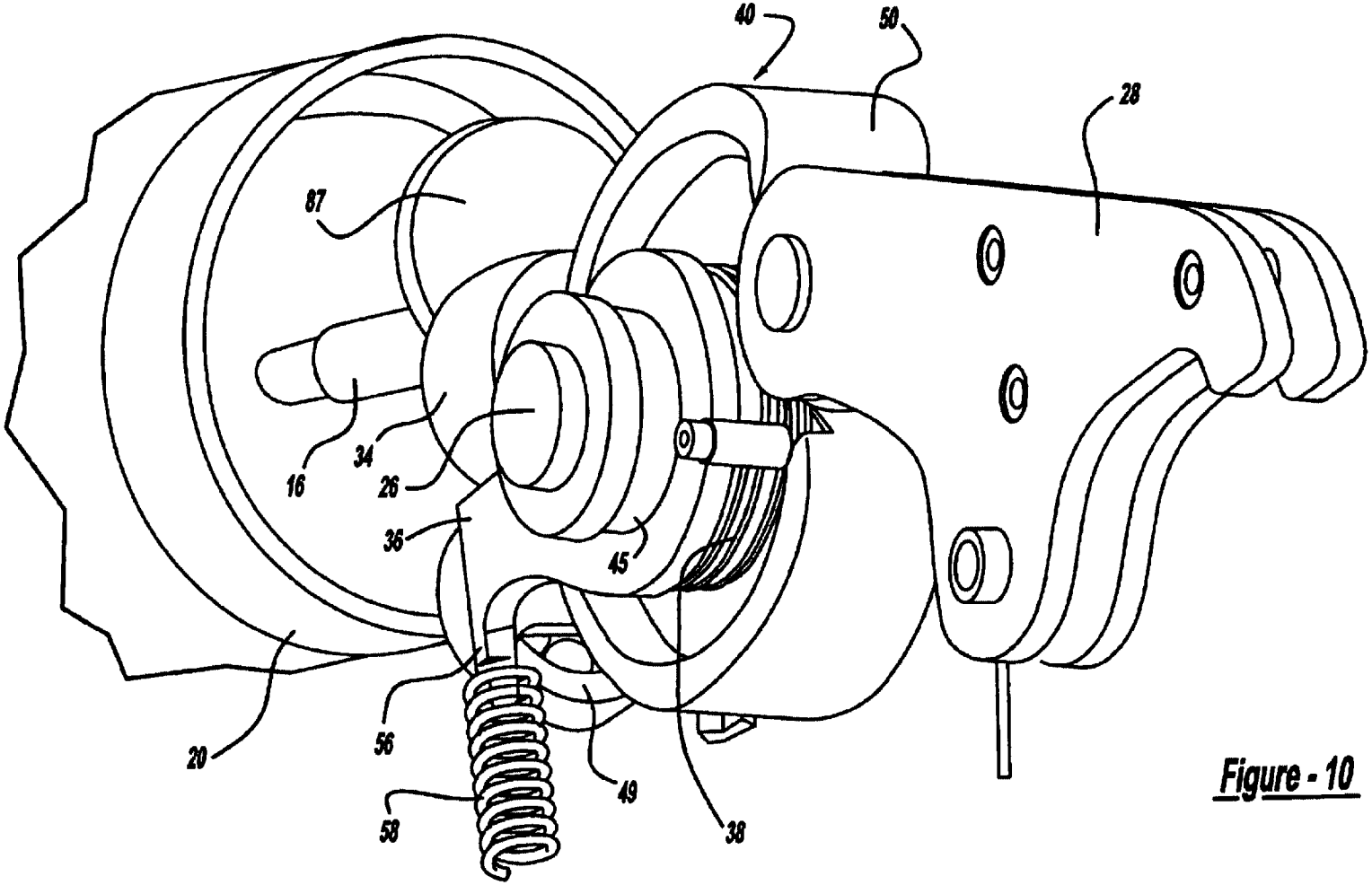
FIG. 10 is a perspective view of the transmission and jaw assembly with the lower jaw removed.

A logic circuit 51 is included that limits the movement of the jaw assembly 19 to one cycle with each activation of the trigger 21. One cycle is defined as the movement of the jaw assembly 19 from a fully open position, to a fully closed (crimping) position and back to a fully open position. The logic circuit 51 may be configured such that the position sensor 52 is disposed on the drive cam 40 and the receiver 55 is disposed on the cam follower 42 (FIG. 9). In an alternative embodiment, the logic circuit 51 includes a position sensor 52 disposed on shaft 16 interconnected to a receiver 55 (not specifically shown). The logic circuit 51 regulates the movement of the shaft 16 to the appropriate number of revolutions (24 for the embodiment disclosed) such that one complete cycle of the jaw assembly 19 is achieved. Once one complete cycle is realized, the logic circuit 51 stops the output of the rotary drive tool 12 thereby causing the jaw assembly to remain in its fully open position able to readily accept the members for the next crimp event. In an alternative configuration, a sensor is mounted to one of the jaw arms and a magnet is disposed on the other jaw arm. (* Inventors please confirm the accuracy of these descriptions) The movement of the jaw assembly 19 would be limited to the cam rotation realized by the logic circuit 51** accordingly. It is understood however, that the logic circuit configuration described herein may be employed in alternative ways.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crimping apparatus comprising:

a rotary drive tool including a trigger mechanism and an output shaft;

a transmission mechanism engaged with said output shaft;

a jaw assembly including first and second jaws, wherein said transmission mechanism translates rotary motion of said output shaft into pivoting motion of at least one of said first and second jaws;

wherein said transmission mechanism includes a first cam drivingly engaged with said output shaft; and wherein said first cam engages a rocker arm for rotating a second cam to cycle at least one of said first and second jaws between a closed position and an open position.

2. The crimping apparatus according to claim 1 wherein said second cam is rotatably driven by a clutch engaged by said rocker arm.

3. The crimping apparatus according to claim 1 wherein at least one of said first and second jaws includes a cam follower attached thereto for engagement with said second cam.

4. The crimping apparatus according to claim 1 wherein said jaw assembly includes at least one tab member for adjustably positioning said jaw assembly in a number of secure positions.

5. The crimping apparatus according to claim 1 wherein one of said first and second jaws includes a piercing end.

6. The crimping apparatus according to claim 1 further comprising a logic circuit that limits movement of said jaw assembly to one cycle.

7. The crimping apparatus according to claim 1 further comprising an internal power source.

8. A crimping apparatus comprising:

a rotary output device;

a transmission mechanism attached to said rotary output device;

a jaw assembly including a first and second jaw arm, one of said first and second jaw arms being pivotally attached to the other and drivingly engaged with said transmission mechanism such that said jaw arms relatively articulate between an open position and a closed position;

wherein said transmission mechanism includes a shaft having a first end selectably attached to said rotary output device and a second end including a first cam attached thereto; and wherein said transmission mechanism includes a second cam variably influencing one of said first and second jaw arms for articulating said one of said first and second jaw arms between a closed and open position.

9. The crimping apparatus according to claim 8 wherein said transmission mechanism includes a rocker arm for translating rotational movement from said first cam to said second cam.

10. The crimping apparatus according to claim 9 wherein said second cam is rotatably driven by a clutch engaged by said rocker arm.

11.The crimping apparatus according to claim 8 wherein said one of said first and second jaws includes a cam follower attached thereto.

12. The crimping apparatus according to claim 11 further comprising an internal power source for providing electric power to said rotary output device.

13. The crimping apparatus according to claim 12 wherein said rotary output device includes a trigger mechanism.

14. The crimping apparatus according to claim 13 further comprising a logic circuit which limits jaw arm articulation to one cycle.

15. The crimping apparatus according to claim 8 wherein one of said first and second jaw arms includes a piercing end.

16. The crimping apparatus according to claim 8 wherein said transmission mechanism and first and second jaw arms are supported by a housing which is rotatable relative to the rotary drive tool.

17. A crimping apparatus comprising:

a rotary drive tool including a trigger mechanism and an output shaft;

a transmission mechanism engaged with said output shaft; and a jaw assembly including first and second jaws, wherein said transmission mechanism translates rotary motion of said output shaft into pivoting motion of at least one of said first and second jaws, wherein said jaw assembly includes at least one tab member for adjustably positioning said jaw assembly in a number of secure positions.

18. A crimping apparatus comprising:

a rotary drive tool including a trigger mechanism and an output shaft;

a transmission mechanism engaged with said output shaft; and a jaw assembly including first and second jaws, wherein said transmission mechanism translates rotary motion of said output shaft into pivoting motion of at least one of said first and second jaws, wherein said transmission mechanism and jaw assembly is supported by a housing which is rotatable relative to the rotary drive tool.

19. A crimping apparatus comprising:

a rotary output device;

a transmission mechanism attached to said rotary output device; and a jaw assembly including a first and second jaw arm, one of said first and second jaw arms being pivotally attached to the other and drivingly engaged with said transmission mechanism such that said jaw arms relatively articulate between an open position and a closed position, wherein said transmission mechanism and first and second jaw arms are supported by a housing which is rotatable relative to the rotary drive tool.

20. A crimping apparatus comprising:

a rotary drive tool including an output shaft;

a transmission mechanism including a clutch, said transmission engaged with said output shaft; and a jaw assembly including first and second jaws, wherein said transmission mechanism translates rotary motion of said output shaft into pivoting motion of at least one of said first and second jaws.

21. The apparatus of claim 20, wherein said transmission includes a first cam engaged with said output shaft.

22. The apparatus of claim 21, wherein said clutch is engaged with said first cam.

23. The apparatus of claim 22, wherein said first cam is eccentric.

24. The apparatus of claim 23, wherein said first cam oscillates to engage said clutch at least once per rotation of said output shaft.

25. The apparatus of claim 20, wherein said clutch further comprises a second cam engaged with said clutch.

26. The apparatus of claim 25, wherein said clutch engages said second cam in one direction.

27. The apparatus of claim 25, wherein said second cam pivots to close one of said first and second jaws.

28. A crimping apparatus comprising:

a rotary drive tool including an output shaft;

a jaw assembly including first and second jaws; and a transmission mechanism including a clutch and an eccentric first cam, wherein said transmission mechanism is engaged with said output shaft and said first cam oscillates to engage said clutch at least once per rotation of said output shaft, wherein said transmission mechanism translates rotary motion of said output shaft into pivoting motion of at least one of said first and second jaws.

* * * * *